US007508141B2

(12) United States Patent
Wong

(10) Patent No.: US 7,508,141 B2
(45) Date of Patent: Mar. 24, 2009

(54) MODULAR DECORATIVE LIGHT SYSTEM

(75) Inventor: Ming Yiu Wong, Hong Kong (HK)

(73) Assignee: WHAM Development Company (HK Pshp), Kowloon Bay (HK)

( * ) Notice: Subject to any disclaimer, the term of this patent is extended or adjusted under 35 U.S.C. 154(b) by 458 days.

(21) Appl. No.: 11/385,227

(22) Filed: Mar. 20, 2006

(65) Prior Publication Data

US 2007/0217209 A1 Sep. 20, 2007

(51) Int. Cl.
*F21S 4/00* (2006.01)

(52) U.S. Cl. ..... 315/185 S; 315/185 R; 315/312

(58) Field of Classification Search ..... 315/178–184, 315/185 R, 185 S, 291, 294, 312; 362/227, 362/564–566, 640, 644, 652–654, 806
See application file for complete search history.

(56) References Cited

U.S. PATENT DOCUMENTS 6,072,280 A * 6/2000 Allen ..... 315/185 S
6,157,139 A * 12/2000 Gibboney, Jr. ..... 315/185 S
7,175,302 B2 * 2/2007 Kazar et al. ..... 362/231
7,202,613 B2 * 4/2007 Morgan et al. ..... 315/312
2006/0039146 A1 * 2/2006 Wu ..... 362/251
2006/0274533 A1 * 12/2006 Richmond et al. ..... 362/311

* cited by examiner

*Primary Examiner*—David Hung Vu
*Assistant Examiner*—Tung X Le
(74) *Attorney, Agent, or Firm*—Curtis L. Harrington; Kathy E. Harrington; Harrington & Harrington

(57) ABSTRACT

A sculptable, decorative light system includes a number of modules of differing lengths which can respond to commands either in parallel or time delay to create pre-selected light colors and sequences. Three miniature connectors are used to create a direct current fed system which has the potential to even out a current demand. Interconnectable lamp modules are provided in sets of 1, 2, 3, 4, and more lengths to create decorative light displays. Each lamp module or string of modules may include a male/plug end and a female/receptacle end.

18 Claims, 5 Drawing Sheets

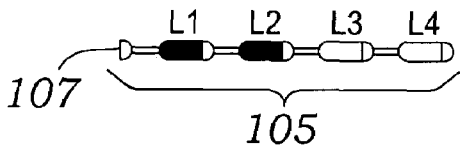
Fig. 11
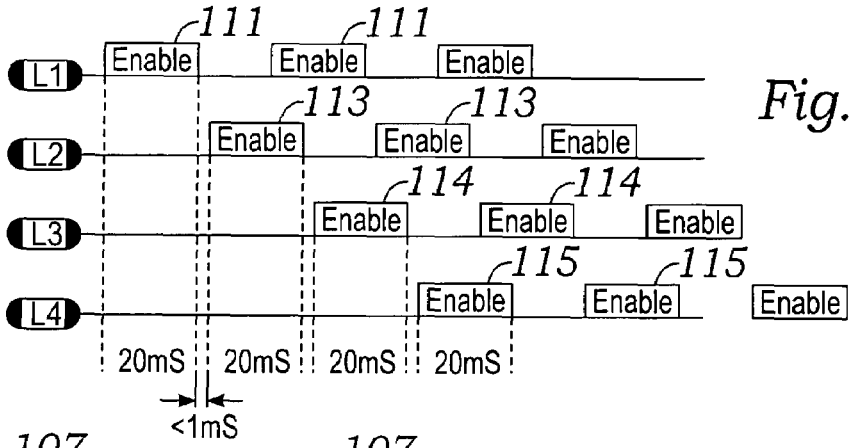
Fig. 12
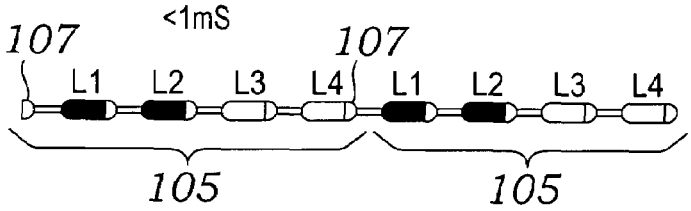
Fig. 13
Fig. 14
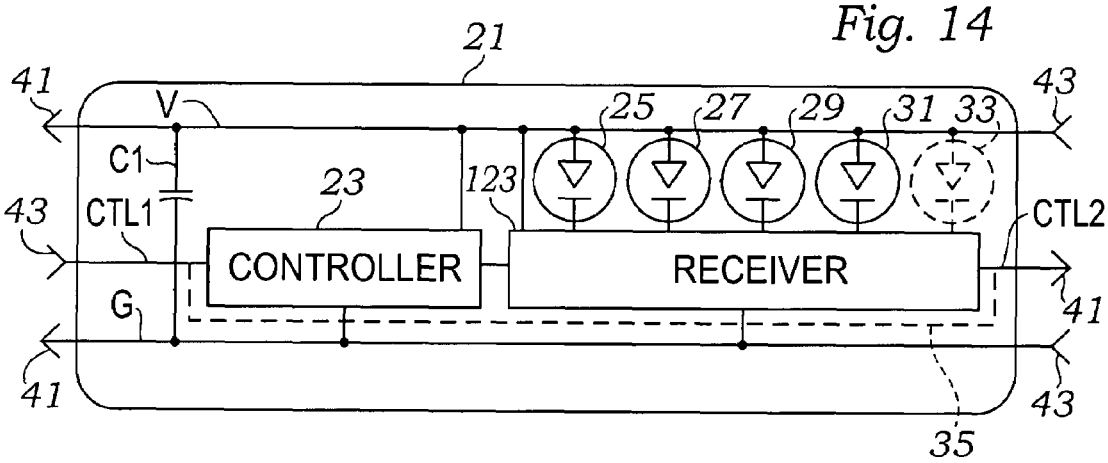
Fig. 15
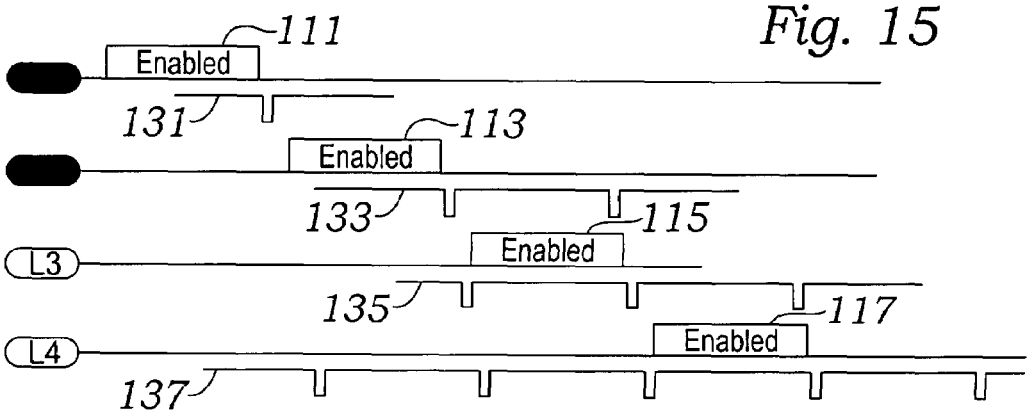

MODULAR DECORATIVE LIGHT SYSTEM

FIELD OF THE INVENTION

The present invention relates to the field of decorative light systems such as those utilized for holiday decorations and those used in year-round displays frequently seen at restaurants, shops, or hotels, and more particularly to programmable decorative light systems capable of displaying a vast selection of colors and flashing patterns.

BACKGROUND OF THE INVENTION

Currently available light sets that may be utilized both indoors and out-of-doors are limited. For holiday lighting, one available option for outdoor lighting is a large-bulb incandescent light set. Such light sets are still available on the market and are often necessary where a user wishes to create a bright and dramatic display. One advantage of large-bulb light sets is that they are typically wired in parallel so that failure of a single bulb does not prevent the rest of the strand from lighting. There are, however, numerous disadvantages to this type of light set. Because each bulb in a given string of lights consumes approximately 5 to 10 watts of power, a single string of 25 to 50 bulbs consumes a significant amount of power and can therefore be expensive to light on a regular basis. Additionally, the large-bulb incandescent light sets generate appreciable amounts of heat which can lead to fire hazards. For this reason, large-bulb incandescent light sets are not properly usable indoors. Finally, large-bulb light sets are costly both to purchase and to maintain.

Another option for outdoor lighting available in the current market is known as a miniature incandescent light set. While this type of light set can be used indoors and out-of-doors and is less expensive to purchase and maintain than the large-bulb incandescent light set, there are several drawbacks associated with miniature light sets.

Lamps on miniature light sets may be connected in series and can be extremely difficult to maintain. In some sets, a single burned-out lamp results in an open circuit that prevents operation of other lamps in the strand until the defective lamp is replaced. In newer sets, a shunt may be present to allow current to pass to the rest of the strand even when a bulb burns out, but the shunt does not prevent malfunction of the entire strand where a bulb becomes slightly dislodged from its socket. In that case, the user must locate the loose bulb and either secure or replace it. This may mean systematically checking each lamp on the strand, which can be both time-consuming and frustrating. Most users are likely to conduct such a search while the strand remains plugged into the power source, thereby risking electrical shock. Moreover, the lamps themselves are small, difficult to grasp, difficult to remove, and delicate to handle. Consequently, time spent searching for a defective lamp and the associated risk of injury from shock or from crushing the glass portion of the lamps while removing and replacing them is burdensome at best. Sometimes, entire light sets are often discarded even if only a single lamp is defective, making repeated purchases of conventional decorative light sets less cost effective than their price would indicate.

The lamps in miniature incandescent light sets are typically driven by low voltage alternating current (AC), which is usually achieved through a step-down transformer that converts standard 120 volt AC power to 12 volt AC power. While this reduces potential danger from voltage as compared to the large-bulb incandescent light systems, it also means that a user must have access to an AC outlet, necessarily limiting the use of conventional light sets to certain applications where AC power is convenient.

Further, if multiple extension cords are necessary, a display can quickly become both unattractive and hazardous with respect to circuit overload and fire. Moreover, although miniature light sets allow a user to connect multiple strands of lamps to one another to create longer strands for more extensive applications or for the convenience of avoiding multiple extension cords in a single application, a user is still constrained by high current draws that could overload the circuit and permanently damage the light set.

Another practical problem with miniature light sets is the difficulty of creating dense or intricate light displays because the lamps on miniature light sets have a fixed space, usually 4 to 6 inches or more from one another. In order to create clusters of lights or complex light displays, a user must re-wrap or double back on multiple times to achieve the desired results. This often leads to problems with tangling and breakage, especially if a bulb is loose or needs replacing or if the light strands must be taken down often, such as in a seasonal or temporary applications. Where a user has completed decoration of one portion of an object and has lights on a string which have not been utilized, extending the string to extend the power to the next object removes the ability to eliminate the presence of lights between objects.

A further issue with miniature light sets is the limited range of available light colors. Even assuming that a user might be satisfied with the few lamp colors available on the market for miniature light sets, changing the color scheme on even a single strand of conventional lights is problematic, and more so for multiple strands of lights. Again, because the lights are small, delicate, and difficult to remove and replace, a user is likely to decide against changing color schemes to avoid the extra effort required to change colors. Further, a change in color scheme would require that a user separately purchase as many lamps as he desires to change, since most miniature light sets only come with 2 or 3 extra replacement bulbs. Although the cost of purchasing all-new replacement lamps is not necessarily prohibitive, the difficulty of finding enough replacement lamps in the desired replacement color is often difficult if not impossible. Practically, then, a user is more likely to purchase an entire new light set when new colors are desired, but even then, the selection of available colors remains small.

Similarly, the range of flashing patterns available in miniature lighting systems is narrow. Available options usually only include full-on, twinkling, blinking, chasing, or a few other similar variations. Flashing patterns in miniature light sets are generally pre-set and cannot be overridden or changed by the user. In fact, in many light sets, the user may have only two choices, either full-on or blinking. In the more basic miniature light sets, the blinking pattern is usually be achieved by replacing a regular lamp with a "flasher" lamp containing a bi-metallic strip. The strip responds to the heat of the bulb's filament and either closes or opens the circuit, turning on or off the bulbs, respectively. Unfortunately, the strand will not light at all when the blinker bulb burns out. Because most light sets only come with one flasher or two at most, any defect or damage to the flasher bulb may further limit a user's options with respect to flashing patterns. Even in the more advanced miniature light sets run by a controller, available flashing patterns are usually preset and the selection is limited.

Finally, transitioning from structure to another, when lighting a series of structures is almost always problematic. For example, where a user wishes to frame multiple windows in decorative lights using a conventional light set, the user must either (1) use separate strands with separate extension cords for each window, or (2) use multiple strands connected together and powered by a single extension cord for multiple windows. In the former case, a user must purchase multiple extension cords and is limited by the number of AC power outlets available. In the latter case, a user must move from one window to the next by extending lighted portions of strands between the two windows, thus detracting from the aesthetic quality of the display.

Control protocol is another major problem. The communications highway in any system has a width which is proportional to its length. It is difficult to provide a high level of control in most systems without knowing the size of the system. Systems which have a variable size are almost impossible to provide with distributed control.

What is therefore needed is a modular decorative light system having components which are connectable in parallel, which are capable of efficient arrangement in any number of different configurations, and which have virtually unlimited programmable flashing and color display capabilities. The optimal modular decorative light system should operate safely using low voltage, use little energy, and have an independent power source allowing it to be used without regard to the location of an AC power source, and is simple and cost-effective to use, maintain, and upgrade.

SUMMARY OF THE INVENTION

A sculptable, decorative light system includes a number of modules or capsules of differing lengths which can respond to commands either in parallel or time delay to create pre-selected light colors and sequences. Three miniature connectors are used to create a direct current fed system which has the potential to even out a current demand.

Interconnectable lamp modules or capsules are provided in sets of 1, 2, 3, 4, and more lengths to create decorative light displays. Each lamp module or string of modules or capsules may include a male/plug end and a female/receptacle end. The complementary ends of adjacent connectors or strings of connectors may be joined to one another directly. Where it is desired for power to be extended to another structure without lights an extension connector can be used.

The interconnectable lamp modules or capsules can be manufactured to rely upon their interconnector conductors and insulation as a string support, or for interconnection using a series of short lengths of flexible tubing encasing the internal wiring and the lamp module. The flexible tubing can help to ensure flexibility throughout the entire light system when the lamp modules or capsules are connected to one another, to thus avoiding breakage and allowing for a wider range of applications.

The male and female portions of each lamp module facilitate a parallel connection of the lamp module with at least 2 other lamp modules or capsules. Additionally, junction connectors in the shape of either a "Y" or "T" can enable multiple lamp modules or capsules to be connected together to form unusual or complex shapes. Because all components of the present invention are standardized construction of the basic module is simple, and several embodiments will be demonstrated. Further, where a user is provided with different lengths having different numbers of modules or capsules, a user can easily expand a light system of any size or complexity at any time to any extent by simply purchasing additional module sets. Thus, the user can avoid the often protracted search for compatible components that is commonly associated with any attempt to expand or modify conventional light sets.

There are several embodiments for the decorative light system, and many the aspects of the different embodiments illustrated may be selected to maximize performance, or to minimize cost, or any combination. In one embodiment of the decorative light system, each lamp module may contain up to three incandescent light sources such as or light emitting diodes (LEDs), and a micro control unit (MCU). Either or both the MCU or LEDs can be mounted on a small printed circuit board (PCB) within the lamp module. For simplicity, the light source for the lamp modules or capsules will herein be referred to simply as LEDs. The MCU inside each lamp module may be as simple as a flip-flop or as complex as a microprocessor.

Regardless of which lengths and which number of multiples of lamp modules or capsules are connected to one another (as described above), the resulting strand of lamp modules or capsules may be ultimately connectable to a master unit which houses both the power source for the light system and, in advanced embodiments, a controller. The master unit is capable of simultaneously accommodating and powering numerous strands of interconnected lamp modules or capsules, the number and size of strands limited only by the capabilities of the power source. Further, each module having a microprocessor assumes a "default program" when it powers up and either fails to sense another source of control or fails to have its control ability overridden.

Optimally, the present invention is direct current driven. This contemplates alternative embodiments including batteries, and an AC-DC converter for derivation of power from an AC current source. Because the decorative light system has low current demand, it may be used with a battery power supply.

A number of operating topologies are illustrated, having different levels of distributed control. At the most rudimentary end of the scale, the lights may be controlled by the timing of a master unit with passive or natural reaction of the light modules or capsules. At the other end of the control scale, module microprocessors may be able to receive instructions on timing, actuation, color, sequence, and the like. In between these two extremes, the master controller may be enabled to automatically determine the number of modules or capsules connected to the master controller, as well as the lengths of the branching connections.

In another embodiment an extended control is facilitated by providing a sets of modules or capsules with an identifiable master module and a number of designated slave modules or capsules. By designating a small number of slave modules or capsules, a slightly lesser degree of independence can be exchanged for less computational capability and expense for the slave units. The overall light system "sculptability" will not suffer as any string can be finished with independent units or groups of independent units. It may be preferable, for example to provide a home sculpting kit having a cluster one independent master module with three slave modules or capsules permanently wired to it, especially where the users will make more intricate patterns with more "Y" connectors and the like. In industrial kits, it may be preferable, for example to provide a sculpting kit having a cluster with one independent master module with nineteen or thirty nine slave modules or capsules permanently wired to it, to save workers the time necessary to make up extended strings, as well as to provide more connective integrity for commercial applications which are more likely to be subjected to wind, longer strings and more stress over a longer period of time.

BRIEF DESCRIPTION OF THE DRAWINGS

These and other aspects of the invention will be better understood from the following description in which reference is made to several drawings of which:

FIG. 11 illustrates on possible temporally based distributed control configuration illustrated with respect to a four module cluster having a single master and three slave capsules;

FIG. 12 illustrates an enablement timing diagram of one possible configuration of the light system;

FIG. 13 illustrates a schematic diagram of a pair of connected clusters;

FIG. 14 illustrates another possible configuration for a light module having a separate downstream receiver;

FIG. 15 illustrates a diagram which illustrates a combination refresh and temporal enable arrangement;

DETAILED DESCRIPTION OF THE PREFERRED EMBODIMENT

Figure 1:
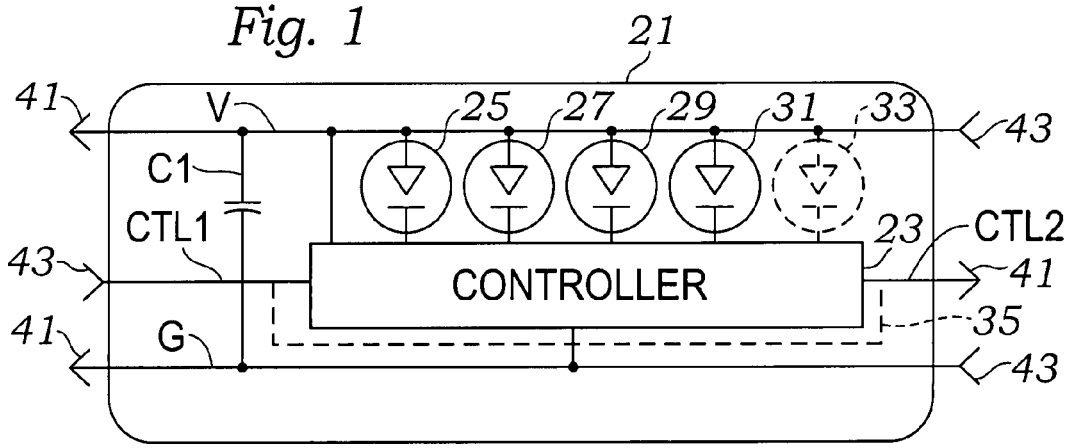
FIG. 1 is a schematic diagram of a potential design for a light module which may be used for a module for the modular decorative light system and includes a series of LED's, a controller, a voltage power supply line, input and output control lines, optional shunt control line and ground line.

Referring to FIG. 1, a description of the modular decorative light system will be initiated with reference to a schematic diagram of a potential design which may be used for a module for the modular decorative light system. A light module 21 is intended to be a repeating unit in a system, regardless of how it is housed, connected or mechanically supported.

The light module 21 has three main conductors which extend through it. A voltage/current supply Line V which is the more positive potential voltage line, a ground line G, and a control lines CTL1 and CTL2. The voltage/current supply Line V may be a conductive line which provides positive potential direct current energy to a controller 23, and a series of LED's 25, 27, 29, 31, and 33 where LED 33 represents further LED's. The controller 23 is connected to the ground line G, and also controls the access to ground for the LED's 25, 27, 29, 31, and 33 internally.

A pair of data lines include line CTL1 as a first line to the controller 23 and a data line including a line CTL2 as a second line seen extending away from the controller 23. Lines CTL1 and CTL2 may be metallic conductors or a fiber optic link. The controller 23 can both transmit and receive communications from lines CTL1 and CTL2.

An optional shunt connection line 35 is shown joining or bypassing CTL1 and CTL2 around the controller 23. Without the shunt connection line 35 any signals passing from CTL1 to CTL2 would be both (1) controlled by any switching internals of controller 23 and (2) subject to any delay (such as transistor-transistor logic delays) in propagating through controller 23. Propagation delay, where the shunt connection line 35 is not present, may be via a pair of series connected inverters or the like. Such a combination produces a natural delay based upon the time for a signal to produce a change in the components through which the signals propagate. Shunt connection line 35, even though it makes signals instantly available downstream (at propagation speeds near the speed of light) can also enable delays downstream by having the controller 23 send an enabling signal after a time delay.

A series of LEDs 25, 27, 29, 31 and 33 are each individually controlled by the controller 23 both in terms of which of the LED's 25, 27, 29, 31, and 33 will be allowed to conduct from voltage/current supply Line V to ground line G, as well as the amount of current which will be able to pass through specific ones of the LED's 25, 27, 29, 31, and 33 which are allowed to conduct. Where at least two of the LED's 25, 27, 29, 31, and 33 are of different color, those two LED's can have their current and their resulting intensity controlled to vary the amount of color intensity which is output. A resultant color will be emitted where the intensity controlled LED's are properly oriented to mix the light which is output. Where least three of the LED's 25, 27, 29, 31, and 33 are of different colors, such as red, green, and blue, those three LED's can have their current and their resulting intensity controlled to vary the resultant color and intensity to cover the visible spectrum. Additional LED's in other frequencies can be used for infrared and or ultraviolet modulation for a variety of applications. For example, a non-fanciful application for the light system might include the need to either attract or not attract insects, or animals, etc to the light. By having the ability to specifically select the frequency of light which is output, these and other goals can be obtained. Further, the ability exists to output a multiplicity of colors, in practical essence simultaneously by multiplexing the combinations of color outputs. For example, three LED's might assume one color for 0.01 seconds and another color for every other 0.01 seconds. Sensors (electrical or biological) would detect both colors. This takes advantage of the fact that rapidly changing light frequencies may appear to be continuous where a sensor's sensitivity is not capable of microsecond discrimination.

The inputs and outputs for the positive voltage potential voltage/current supply Line V, control lines CTL1 and CTL2, and the ground line G are shown as a series of arrows with the outward pointing arrows indicating what may be male connectors and the inward pointing arrows indicating female connectors. The combination shown helps to maximally eliminate a wrong connection. All of the connectors to the left of the figure could be male connectors and all of the connectors to the right could be female connectors, or vice versa. The use of a connector with a combination of both male an female connectors can serve to further eliminate both the chance of mis-connection as well as reduce the chance to deliberately contravene the connection layout.

Where a number of light capsules or modules 21 (and will be hereinafter referred to as modules 21) are provided, a module located either to the left or to the right of the light module 21 seen in FIG. 1 will interconnect. The only more stringent suggestion is for each side of the light module 21 to have a male/female orientation with respect to the opposite side of the light module 21.

Also seen in the light module 21 is an optional capacitor C1 connected between the voltage/current supply Line V and the ground line G. The capacitor C1 will provide for some energy storage and energy demand smoothing, and can be of any capacitance value. Given that the duty cycle for the light modules 21 will vary, the building in of some energy storage capacity will enhance the capability during moments of high energy usage. As by example, where all of the lights are to flash on at once, an upstream power source would experience a surge. The use of capacitor C1 will help to smooth the demand for power and will help even the current flow into a string of light modules 21.

The selection of the controller 23 and its abilities, in conjunction with a master controller will determine the level of sophistication which a formed array of light modules 21 will have as well as the other functions it will be permitted to perform. Non "light display" duties for the controller 23 can include (1) a daily timer to turn the light system on and off at scheduled times during daily, weekly or even monthly periods, (2) selection and execution of different lighting patterns during different portions of the day, (3) a sequencer duty to synchronize all of the modules 21 so that they flash the patterns, (4) a real time system status check system to report on the state of LED's 25, 27, 29, 31, and 33 at any given time.

A discussion will be illustrated without the presence of the optional shunt connection line 35. In this configuration, the only connection through the controller 23 is via a "message passing" function which is delayed by the time for the transistor-transistor logic to act to receive the signal and pass it on. Further, controllers 23 in each of the light modules 21 can act to return a signal to the controller from which the signal was received. Each of the controllers 23 can further record the passage of time and be set to control the LED's 25, 27, 29, 31, and 33 at different times.

As an example, one side of the module 21 has two male connectors 41, while the other side of the module 21 has two female connectors 43. In deciding to have such a configuration, the strength of the male connectors 41 especially where there would only be one of them at one end of the module 21, should be taken into consideration.

With the optional shunt connection line 35, a controller would have the ability to communicate with all of the modules 21 with no time delay beyond the propagation time of conducted electromagnetic signal. In this configuration an address of each module 21 could be used, along with propagation time, to enable a controller to make a complete map of any number of modules 21 which are interconnected, including their adjacency, constructed pattern and number of modules 21 within the pattern. Modules 21 may have information on their identity.

Figure 2:
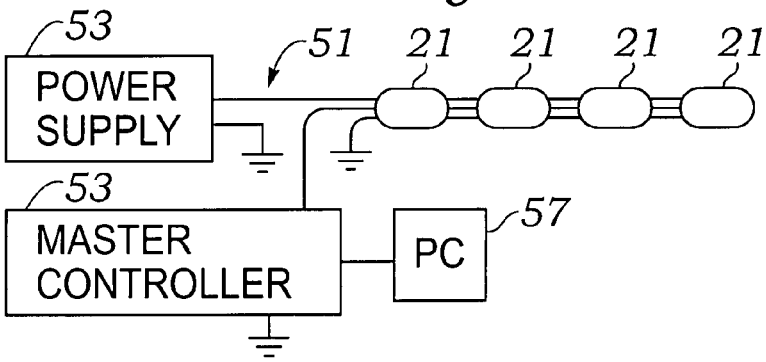
FIG. 2 illustrates a modular light system which incorporates a plurality of the light modules or capsules seen in FIG. 1 and in addition a power supply, master controller, and interconnection to a personal computer.

Referring to FIG. 2, a schematic diagram of the next most basic arrangement of components which can form one embodiment of a modular light system 51 is seen. This specification will show several potential configurations for a modular light system 51 and all seen herein, and more, are contemplated to fall within the description of "modular light system 51".

Referring again to FIG. 2, a power supply 53 supplies a direct current voltage to the voltage lines V of a series of connected light modules 21. A master controller 55 is connected to the CTL1 line of the first light module 21. For subsequent light modules 21, the CTL1 line of each module is connected to the CTL2 line of each light module 21 before it. All of the light modules 21, power supply 53 and master controller 55 have a common ground.

In the basic configuration of FIG. 2, consider the case where each of the light modules 21 lack the optional shunt connection line 35. Where the master controller 55 sends a signal to the CTL1 line of the first light module 21, the controller 23 of the first light module 21 will receive an instruction to illuminate LED's 25, 27, 29, 31, and 33 for a given duration. The controller 23 may have a natural time delay for passing the signal on to the next light module 21. Further, the controller 23 may be programmable to have a series of delays. In a rudimentary embodiment, a master controller 55 may simply have a timer to initiate a simple "on" lighting instruction. In this case, the first light module 21 will illuminate for a limited time, with the lighting instruction being passed on to a further light module 21 after the time delay. A "marquis" moving light effect will then be created. It is hoped that the time delay between the individual light modules 21 will be even so as to create an even pattern.

Beyond a simple trigger pulse, the master controller 55 can deliver a series of pulses with additional information, including color and duration over which each of the LED's 25, 27, 29, 31, and 33 will light, as well as the intensity of light output. A master controller would typically send out instructions as a series of timed serial pulses. As described previously, the number of consecutive interconnected light modules 21 in a line can vary based upon being connected by the user to "sculpt" a particular lighting arrangement. If the light modules 21 are limited to simply passing a forward signal, a marquis lighting arrangement may be all that is possible, perhaps with variations including passing the information, including intensity, color and timing.

Where the controller 23 is provided with the ability to transmit a return signal and pass a return signal from its control line CTL2 to its control line CTL1, a master controller 55 can ascertain the length of the longest number of light modules 21 connected to it by sending a signal to each controller 23 requiring it to pass the signal along and pass a signal back to the master controller. Where the master controller 55 is able to ascertain the total length of the longest chain of light modules 21, it can adjust its commands to pause to allow the propagation of signals to reach the endmost points of the longest chain of modules.

Further, once the master controller 55 has ascertained the time for distant most propagation, timing information can be sent over the CTL1 line from the master controller 55. Once the propagation time is known, the master controller 55 can send a command to the first light module 21 instructing it to flash at some time quantity later, then subtract the propagation time to the next module and send the time to the next module. At the proper time, all of the light modules 21 will flash on.

Taking the programming to a next level, once the propagation time is known, the master controller 55 can send a table of commands and times to the first light module 21. The command set which instructs it to flash with certain intensities of color, duty cycles and times is then stored, along with instructions to block passing on this information and block the storage of further information, until either sufficient time passes or until all of the stored instructions are executed. The next command set of additional tables sent from the master controller 55 will then be simply passed along to the first light module 21 where they will not be stored and will be simply passed along rote to the second one of the light modules 21 with instructions to store, block passing on this information and block the storage of further information, until either sufficient time passes or until all of the stored instructions are executed. Once all of the controllers 23 are programmed, and at the appropriate time, all of the light modules 21 start their executions. A generally necessary variant of this technique is that all of the controllers 20 need to be synchronized and have an individual time base so that the initiation of action will occur as nearly simultaneously as possible.

Inherent, even in the simplistic design of modular light system 51 is the possibility of a significant amount of analytical feedback which can be available in the master controller 55. First, the master controller 55 can be able to be networked to a personal computer, seen as PC 57, to assist users in programming the master controller 55. Master controller 55 can produce a real time map of the particular configuration of the light modules 21 which the user has constructed. From simple configurations such as a linear extension of a series of modules to complex branching structures, the master controller 55, or a personal computer connected to the master controller 55 could sense the connected configuration. Once the connected configuration is known, the user can use the configuration to specify a more specific performance regiment for the light modules 21.

As a simple example, assume that a first hundred light modules 21 were connected about a first window frame, with an extension section being connected from the first window frame to a second window frame and that a second 100 light modules 21 were connected around the second window frame. The master controller 55 would sense a single string of 200 light modules 21 The user could then use the master controller 55 to specify the first string of 100 light modules 21 as a first zone and a second string of 100 light modules 21 as a second zone. The commands for the two zones could be separated such that one of the zones is delayed with respect to the other or other programming protocol, such as insuring that the zones are never the same color or perhaps sometimes the same color or that the two zones act in concert as common zones.

Figure 3:
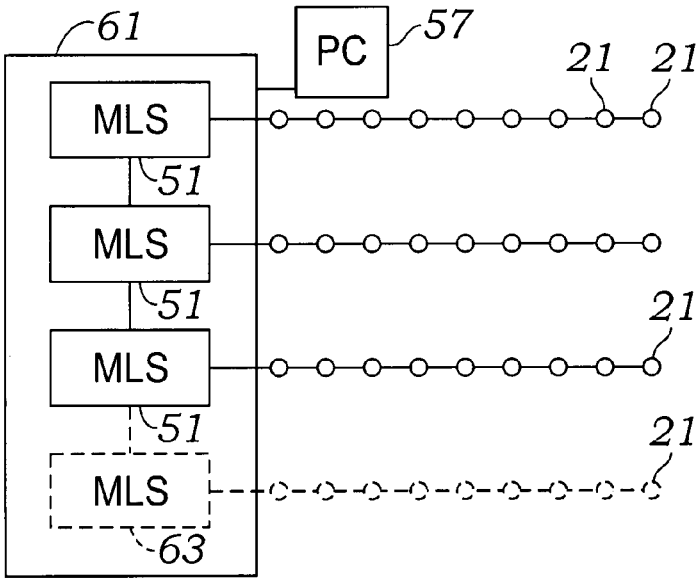
FIG. 3 illustrates a lighting master system in which a master system housing contains a plurality of modular light systems as seen in FIG. 2 and in which the modular light systems master controllers are connected to communicate with each other an to interface with a personal computer.

Referring to FIG. 3, a series of modular light systems 51 seen within a master system housing 61. The master controllers 55 of the modular light systems 51 are preferably connected to each other and to a personal computer PC 57. In this manner, each of the master controllers as modules with the abbreviation MLS can be housed within one master system controller 61. Either the PC 57 or one of the master controllers 55 within one of the series of modular light systems 51 can control all of the other modular light systems 51. Further, each of the modular light systems 51 may physically represent a single "plug" access on the master system controller 61.

A single dashed line modular light system 63 represents a plurality of modular light systems 51. As such, a master system controller 61 can have many, many modular light systems 51. The ability for the user to precisely "sculpt" a complete distributed lighting system is facilitated.

Figure 4:
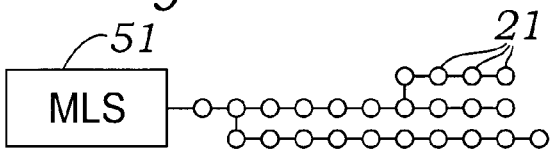
FIG. 4 illustrates a schematic view of the modular lighting system seen in FIGS. 2 and 3 but shown connected to a number of modules or capsules which branch downstream of a single connection to the modular light system.

As an example of the complexity which could be involved, in FIG. 4, a single modular light system 51 is shown as being connected to a number of light modules 21. There are two "Y" branches. The modular light system 51 master controller 55 should have the ability to reproduce a mathematical representation of the schematic shown in FIG. 4 in its memory based not upon programming, but based upon probing the light modules 21. Probing techniques could be anything from sending a signal with an encoded time delay and measuring the time to receive a return signal, to having each of the controllers 23 assigned a random alpha numeric code and having the master controller 55 probe for it.

Figure 5:
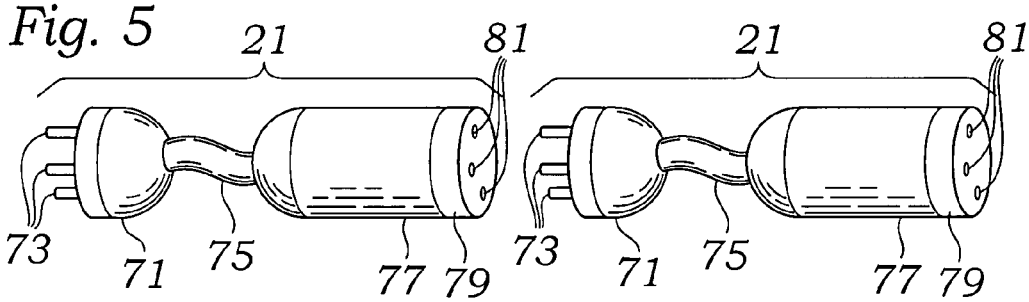
FIG. 5 illustrates one possible mechanical configuration for a light module, and shown next to another identical light module to indicate expected interconnectivity.

In terms of a physical reality for the light modules 21, and Referring to FIG. 5, one possible overall schematic representation of each light module 21 is illustrated. The light modules 21 can be manufactured in an extremely dense packing. However, for most decorative displays, each of the light modules 21 will include a male plug portion 71 having a series of contacts 73. The male plug portion 71 will be followed by some form of extended conductor set 75 (which will include at least voltage/current supply Line V, ground line G, and CTL1 and or CTL2). followed by the light module 21 main body 77. The main body 77 will be followed by some form of female connector 79 having a series of engagement apertures 81.

Where a male end connector is to have all protruding extended conductor set 75, the orientation of the extended conductor set 75 should be so as to prevent as much as possible a user from mis-connecting the light modules 21. AS is shown, the three series of engagement apertures 81 are arranged about the periphery of the female connector 79 on one side of the circular female connector 79 to insure that each male plug portion connects into each female connector 79 in only one orientation. Cost and complexity are always factors, but any safety mechanisms which prevent wrongful connection and operation are preferable.

As stated with respect to the schematic for FIG. 1, it may be preferable for connectors to have a combination male and female character to encourage and ensure proper connectivity. Other variations are possible, and the structures seen in FIG. 5 are for illustrative purposes only. For example, the female connector 79 could be connected to the main body 77 by a conductor set 75 while the male plug portion 71 could be formed integral with the main body 77.

The conductor set 75 is representative of any form of flexibility provided between serially connected main bodies 77. The main body 77 would contain one or more of the LED's 25, 27, 29, 31, and 33, controller 23, and optional capacitor C1. Where such flexibility was not provided by some length of interconnecting material, flexibility would need to be provided by an outer skin, or if the module 21 were left rigid, a series of angled connectors would be necessary. Of course, the modules 21 may be provided in a dense packed orientation, but further connectivity requirements might provide disruption to the pattern.

For interconnectivity between illuminated structures, an interconnector cord 87 which can be of variable length as shown by the broken line indication at the center. It is contemplated that a series of interconnector cords 87 may be available in a system available as a kit, and that additional interconnector cords 87 may be independently obtainable in order to customize the user's capabilities.

Figure 6:
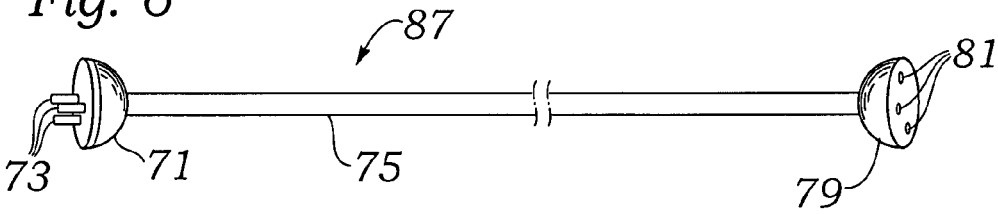
FIG. 6 is an interconnector cord which may be of any length and which may be used to connect two light modules or capsules where it is desired to belay the existence of light modules or capsules over the length of the connection of the interconnector cord.

The modules 21 seen in FIG. 5 might consume undue time in constructing large displays. As a result, much building blocks, the modules 21 should be available in sets of multiple modules 21 having a spacing as close as possible to the spacing which would be available to individual ones of the modules 21 were they to be connected together. Referring to FIG. 6, a two module set 91 having two main bodies 77 and two conductor sets 75 is shown. Similarly, referring to FIG. 7, a three module set 93 having three main bodies 77 and three conductor sets 75 is shown.

Figure 9:
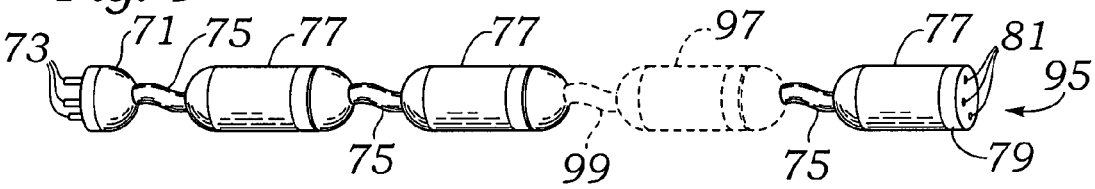
FIG. 9 is a perspective view of a connector set which may have a large multiplicity of light modules or capsules.

The number of main bodies 77 and conductor sets 77 can be increased in even, integer numbers to make an entire series of serially connected modules 21 to enable a user to rapidly and easily complete a number of wiring applications. Referring to FIG. 9, a multiple module set 95 having three main bodies 77 and three conductor sets 75 on either side of a dashed line main body 97 a dashed line conductor 99 is shown. The a dashed line main body 97 represents a multiplicity of main bodies 77, while a dashed line conductor 99 represents a multiplicity of conductor sets 75.

In a typical kit, the numbers of modules in a set may number the same as denominations of money, such as 100, 75, 50, 25, 10, 5, 4, 3, 2, & 1. A designer would then be able to make a much lesser number of interconnections to distribute modules 21 over a given area. Where 153 were needed, only three of the denominations listed above would be needed and with three connections. Where denominations of numbers, such as 100, 75, 50, 25, 10, 5, 4, 3, 2, & 1 are used, the identity function may reside in a controller 23 in the lead module 21. This will help reduce the number of addresses and enhance distributed control.

Figure 10:
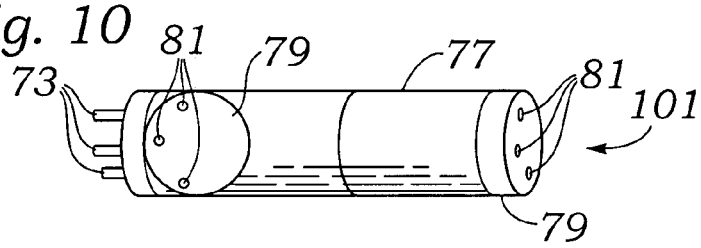
FIG. 10 is a multiple interconnector tap which can be used to enable multiple branches for further lines of connected light modules or capsules.

Referring to FIG. 10, a multiple interconnector 101 is shown. The multiple interconnector 101 has a plurality of female connectors 79, each having engagement apertures 81. The female connectors 79 are seen adjacent the series of contacts 73 so that any module 21 connected will have about the same spacing from the main body 77 of a previous module 21. In addition, where it is desired that the multiple interconnector 101 not disrupt the spacing of the light array, the multiple interconnector 101 will preferably have a main body 77 containing the controller 23, LED's 25, 27, 29, 31, and 33 and optional capacitor C1.

A further female connector 79, or two may be located on the other sides of the multiple interconnector 101 to form a "T" connector. Where disruption of the light pattern is not a problem, such as where the use of the multiple interconnector 101 in conjunction with 2-3 of the interconnector cords 87 will occur, the multiple interconnector 101 can have more female connectors 79 and no main body 77 containing the controller 23, LED's 25, 27, 29, 31, and 33 and optional capacitor C1.

Referring to FIG. 11, a schematic view of a cluster 105 of four modules labeled as L1, L2, L3, and L4 are seen. A schematic plug 107 is shown to the left to be plugged into a power supply 53 or into another cluster 105 or another module 21, or master controller 55, or modular light system 51. Cluster 105 is configured such that module L1 includes the controller 23 seen in FIG. 1, which includes the ability to decipher addresses, send information to other addresses, and generally have the distributed flexible control previously described. Modules L2, L3, and L4 have a more elementary mechanism. A first level of simplification can involve the elimination of flexible addressing for modules L2, L3, and L4. Where the Modules L2, L3, and L4 are hard wired to a master module L1, master module L1 can identify itself as having three dependent slave modules in its identifier.

This can enable a more simplified form of programming and enable a master controller 55 or modular light system 51 to more rapidly assess the shape and control topography of an assembled array of modules 21 or clusters 105. Since the master module L1 is hard wired for the modules L2, L3, and L4, as well as their order, the addressing and accountability for the modules L2, L3, and L4 can be eliminated by, for example, a temporally based addressing scheme.

Here, module L1 will preferably have a switch command set which may be separated from its controller command set. The controller 23 of module L1 outputs an instruction, including light commands and timing during a number of enable times. The module L1 may have an independent instruction receipt processor especially to enable the manufacture of modules L1 to proceed the same as modules modules L2, L3, and L4 with module L1 having the addition of addressability.

Referring to FIG. 12, one embodiment is shown as a timing diagram for the receipt of information by modules L2, L3, and L4, and by a receive switch setting in module L1 if it is configured that way. In this manner, the master module L1, especially if it were configured as a full controller 23, could use common lines to instruct modules L2, L3, and L4, and possibly its own programming receiver in L1, without the necessity for addressing.

Module L1 has an instruction receiver which is timed to receives instructions at a first ENABLE time 111. Likewise, modules L2, L3, & L4 have instruction receivers which are timed to receive instructions at second, third and fourth ENABLE times 113, 115, and 117. The ENABLE times 111, 113, 115, and 117 may be set on power up, especially since all of the modules L1, L2, L3, & L4 share common power and will be energized simultaneously. Other details seen in FIG. 12 is that one possible time period for the time duration ENABLE times 111, 113, 115, and 117 may be 20 milliseconds with a gap between The ENABLE times 111, 113, 115, and 117 which may be set to be as little as one millisecond.

As shown, the modules L1, L2, L3, & L4 are all controlled by a controller 23 in the module L1. The controller 23 in module L1 must still be set for any communications to occur to signal that it is responsible for the next four modules 21 in a line. In this way, instructions are received on how to time and operate the ENABLE times 111, 113, 115, and 117 so that instructions on how to time and operate modules L1, L2, L3, & L4 may be utilized. As such, a cluster 105 can receive a lesser magnitude of information than would be the case if all the modules L1, L2, L3, & L4 had to have separate addresses and individual instructions. Beyond savings in address information, other information can be saved, especially sequencing. Where it is known that modules L1, L2, L3, & L4 have a logical even delay time between them, a triggering instruction may include simply a difference time with respect to the module's ENABLE time 111, 113, 115, and 117. As such, the use of a time based communication window can provide further advantages in data reduction.

Referring to FIG. 13, a pair of connected clusters, including cluster 105 connected to a cluster 109, is shown. The first cluster 105 is again labeled as modules L1, L2, L3, & L4. The second cluster 109 is labeled as modules L5, L6, L7, & L8. Where the physical components in second cluster 109 is the same as the physical components in cluster 105, two possible control modes are possible.

First, cluster 107 module L5 has the ability to act as a controller of module L5 (itself), and modules L6, L7, & L8. In this mode, the module L5 controller 23 would have its own cognizable address and communication would occur up and down the string, but with module L1 registering a presence for itself and its slave modules L2, L3, & L4, and with module L5 registering a presence for itself and its slave modules L6, L7, & L8.

In the alternative, and especially where a controller 23 is separate and apart from a timed instruction receiver in module L5, the controller 23 in module L5 can simply step aside by either temporarily disabling itself or by receiving a signal from L1 indicating that L1 is acting as controller and either temporarily disabling itself or suppressing its control function. If this is the case, there will need to be some receipt of information by controller 23 in module L1 to let it know that controller 23 in module L5 is stepping aside, and that the controller 23 of module L1 is now responsible for eight modules L1, L2, L3, L4, L5, L6, L7, & L8.

In the "step aside" mode, the diagram of FIG. 12 is simply expanded to make eight cascading enablement times. However, using the timing set forth for four modules L1, L2, L3, & L4, if 83 milliseconds are necessary to communicate with four modules, 167 milliseconds will be necessary to communicate with eight modules L1, L2, L3, L4, L5, L6, L7, & L8. In this type of format, the number and complexity of patterns per unit time might begin to be compromised. Other more basic patterns like the marquis snaking pattern would probably be unaffected as this is a basic pattern and doesn't require many split second changes within the modules.

However, using a distributed control where no "step aside" occurs is preferred. Further, depending upon the overall usage intended for the constructed lighting system, the "slave" modules in a given cluster 105 may be fewer so that the addressing burden will be only slightly reduced. As a cluster 105 has more and more modules, L1, L2, etc, additional time must be taken to achieve a temporally based communication with the slave modules in accord with the chart shown in FIG. 12. Thus, a system intended for home use with a relatively small number of program options might be acceptable to have a larger number of slave modules because communication of only basic routines could be more easily done within a longer time period. With more complex patterns, many more of the individual controllers 23 might have to retain more complex patterns and be located more widely in order to carry out the timing of the more complex routine.

When used in a distributed control sequence, the controllers 23 within the master modules L1 and L5 can be set to (1) control the on and off state of the LED's 25, 27, 29, 31, and 33 within each module either by a temporally based instruction set received in advance or by other method, (2) control the on and off state of the LED's 25, 27, 29, 31, and 33 within any size cluster, and including the case where the next-most controller 23 in a downstream cluster 105 either "steps aside" or is malfunctioning, or (3) act as refresh controller to alter, and or update the commands of modules L1, L2, L3 & L4 within immediate control.

Any secondary or downstream controller 23, such as would be located in module L5 would operate to (1) control the on and off state of the LED's 25, 27, 29, 31, and 33 within its modules L5, L6, L7 and L8, and (2) to act as refresh controller to alter, and or update the commands of modules L5, L6, L7 & L8 within immediate control.

In terms of pulse control, any pulse control scheme can work with the lighting system thus described. As an example, several pulse widths can be used to save pulse counting time. For example, at power up, a one millisecond pulse can represent one count. A three millisecond pulse can represent 10 counts. A five millisecond pulse can represent 20 counts. A four millisecond pulse can be used as a synchronization bit to indicate the start of a command line. Data bits "0" can be one millisecond long while data bits "1" can be two milliseconds long.

A primary controller can send out a number of two millisecond bits in serial order to indicate the capsular light module 21 to be lit. The sense of the pulse can be interpreted by each receiver in each of the modules L1, L2, L3, L4, L5, L6, L7, & L8. In this case, which is similar to the "step aside" manner of functioning, an 8 pulse train activates L8, a seven pulse train activates L7, and so forth. The pulse trains can be used for anything from real time activation to indicating which instructions are to be associated with which the modules L1, L2, L3, L4, L5, L6, L7, & L8. This can be used instead of, or in addition to, the enablement the pulse diagram seen in FIG. 12.

This same pulse scheme can be used to indicate that a module L1, L2, L3, L4, L5, L6, L7, & L8 is to be refreshed.

Referring to FIG. 14, a light module 121 is configured with a separate downstream receiver 123. This is one such design which may be illustrative of a controller 23 in a common light module 121 with a separate receiver 123.

Referring to FIG. 15, a combination refresh and temporal enable arrangement is shown. If a controller such as a master controller 55, or controller 23, sends a pulse to toggle an LED module following a controller during multiplexing the module L1, L2, L3, L4 corresponding to the Nth pulse will be refreshed. The affected LED's 25, 27, 29, 31, and 33 may be either on or off in accord to the definitions in a pattern table. The pulse patterns are seen as pulse patterns 131, 133, 135 and 137 which are associated with L1, L2, L3 and L4, respectively.

The lighting system of the invention as shown in FIGS. 1-15 is an upstream control system. As seen in FIG. 2, the personal computer 57 programs the master controller 55. Where the master controller 55 is present, it exercises default control over all downstream strings. Where a number of modular light systems 51 are cross linked as seen in FIG. 3, one of the master controllers of the modular light systems 51 takes over as the complete master controller 55 and controls all of the other modular light systems 51. In the alternative, the personal computer 57 can coordinate all of the modular light systems 51 and set them to its timer, with the personal computer 57 acting as the supreme master controller. Where a lighting system is complex, and involves a number of modular light systems 51, the personal computer 57 may become part of the complete light system, especially where it is used to set a menu for a series of complex interactions and/or where the master controller 55 with the most capacity is insufficient. Just as the system can have lights added at the farthest end, upstream computing and controlling power can be relied upon.

Conversely, when any upstream computing device is not present, downstream computing devices take over. If the personal computer 57 is not present to control the master controller 55, the master controller 55 takes over. If the master controller 55 is not present, the controller 23 in the most upstream position in a line of light modules 21 takes over with its own default program. Generally the further away from the master controller 55, the more limited the number of displays and the more simplistic their pattern.

Figure 16:
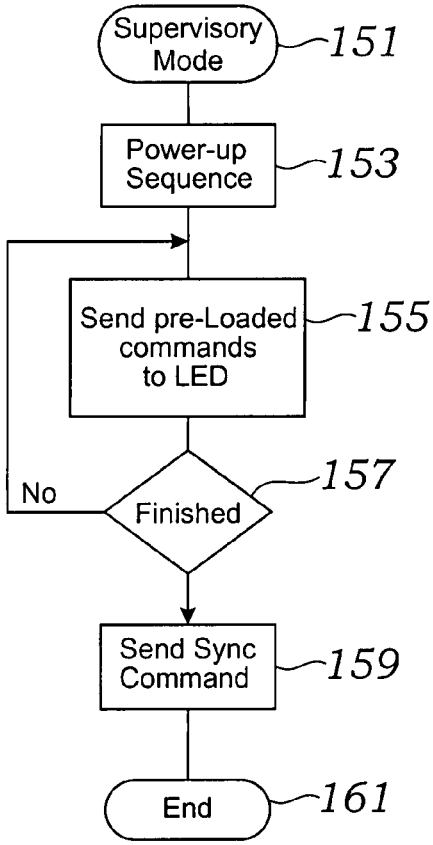
FIG. 16 illustrates one possible logic flow diagram for a supervisory mode which may be programmed into a master controller.

Referring to FIG. 16, one embodiment of a supervisory mode as may be programmed into the master controller 55 is shown. A supervisory mode oval 151 occurs when the master controller 55 is under power conditions and when no further upstream control occurs. Lack of upstream control occurrence may be sensed by the passage of time or from the absence of a signal on startup.

The logic then flows to a power-up sequence block 153 where any sequential switching commands to downstream light modules 21 is performed, which may include power commands, a signal indicating that any control which is located farther downstream is to be suppressed, or an override to any further downstream pre-programmed operations. Logic then flows to a "Send Pre-Loaded commands to LED" block 155. During this step, commands may be distributed to specific controllers 23, or in the alternative a cascade of commands may be initiated through the controllers 23. This process may include a series of stepwise actions as well as feedback from the series of controllers 23 verifying that all pre-loaded commands are received and acknowledged.

The logic next flows to a Finished decision diamond 157 where a set of conditions, which may be interactive, are tested. If the completed conditions are not satisfied, a "no" result sends the logic back to the "Send Pre-Loaded commands to LED block 155. A "yes" result sends the logic flow to a "Send Sync Command" block 159. Depending upon the configuration of all the light modules 21, their status as an independent module 21, or a master module L1 in charge of a series of slave modules L2, L3, and L4, a synchronization command is sent to start the light show in a simultaneous manner. The "Send Sync Command" block 159 may send its signal after probing the light system and knowing how many lights are interconnected, their pattern and propagation times to communicate with all of the controllers 23 in the system. Synchronization can be done by setting all actions to occur in response to a synchronized time. An End oval 161 is present to finish the flow chart, but during typical operation the end command would occur in the individual controllers 23 at the end of the show sequence, or on power down.

Figure 17:
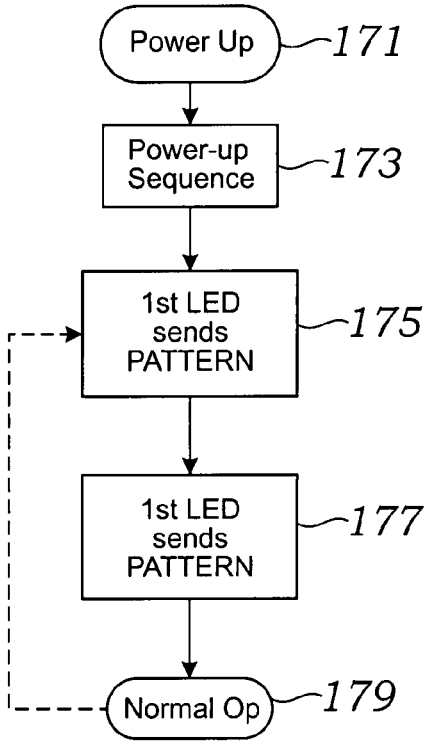
FIG. 17 illustrates one possible logic flow diagram for a non-supervisory mode which may be programmed into each of the controllers 23 is shown.

Referring to FIG. 17 one possible embodiment of a non-supervisory mode as may be programmed into each of the controllers 23 is shown. This non-supervisory mode will occur in each of the light modules 21 having controllers 23, upon sensing or discovery of the lack of upstream control. This may also be sensed by the passage of time or from the absence of a signal on startup.

The logic begins in a Power Up starting oval 171. Once power is established and stabilized, the logic then flows to a Power-up sequence block 173 where power levels to the various LED's 25, 27, 29, 31, and 33 are initialized and where any of the capacitors C1 fill with charge. Typically the power-up sequence can include power control as well as sensing power supply stability before startup. For example, downstream modules 21 will power up slowly as the upstream capacitors C1 are filled with charge. Other power introduction transient inductance and capacitive effects will settle down under the control of block 173.

The logic next flows to a 1st LED sends PATTERN block 175 where the first pattern is directed downstream to as many modules 21, modules L1, and their slaves L2, L3, L4, L5, L6, L7, & L8 as are appropriate for the configuration of the light system as the user has both physically configured and programmed it. Again, sufficient time or feedback or both can be had before the logic is allowed to flow to a 1st LED sends SYNC block 177 in which a starting synchronization command is sent to all of the downstream modules 21 and L1, as well as other types, to either begin action or to set a time during which action is to begin.

Lastly, the logic flows to a Normal Op(erations) oval 179 where the patterns are displayed by the various downstream modules 21 and L1, as well as other types. Where the individual controllers 21 or L1 are programmed to spend a given amount of time on a sequence and jump to another sequence, this occurs naturally within the Normal Op(erations) oval 179. In the alternative, the Normal Op(erations) oval 179 may correspond to one pattern which may continue while power is present, but may have been randomly selected in the 1st LED sends PATTERN block 175. An optional return arrow may be included from the Normal Op(erations) oval 179 back to the 1st LED sends PATTERN block 175 to enable changes in patterns based upon programmed normal operations.

Although the details of a power switching system may change from one embodiment to another, referring to FIG. 1, at idle state CTL1 and CTL2 may remain at input mode. This mode preferably changes only when data is sent. Pulses may be echoed to the sender to insure safe sending and receiving. Typically if there is no response after a pre-determined time interval, the sender will know that it is at the end of a chain. During this process a module at the head of any given chain will have recorded the number of capsules or modules 21 beyond it and thus "records" a tally amount as the communication goes back and forth. If no signal is received after a given time, then the last recorded tally will indicate how many modules are beyond a head module. There can be several head modules.

The structures thus shown illustrate a schematic construction for the modular light system 51, regardless of the linear configuration of the light modules 21. Given that LED's 25, 27, 29, 31, and 33 are typically very compact and bright points of light, leaving them as a single mounting within the light module 21 would create a series of points of light whose spacing could be increased by providing longer extended conductor sets 75, longer light modules 21, and the like. The ability to compact the light spacing might depend upon forming 25, 27, 29, 31, and 33 in one package, providing smaller circuit supports, smaller light modules 21, and eliminating conductor sets 75, or even building a single cluster 105 with several or even hundreds of densely packed light modules 21.

Further, although the light modules 21 have been shown in a two dimensional schematic view, the geometric realization may involve parallel duplication of each of the light modules 21 along a length of a cluster 105 or even within a light module 21. Simplest duplication may involve a bilateral duplicative positioning of modules, or LED's 25, 27, 29, 31, and 33 so that illumination is simultaneously had in two directions. For lighting embodiments where a larger diameter display is constructed, a series of light modules 21 could be extended around a circular structure. In other cases where the lights are to extend from one side of a string only, the connectors and light modules 21 can be stabilized against a surface to prevent spiral twisting.

Figure 18:
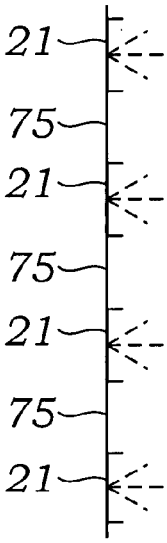
FIG. 18 illustrates a schematic view of a string of light modules which are evenly spaced, separated by conductors, and in which illumination is directed to one side of the string of light modules.

For a given linear segment of linear extent of light modules 21, light can be directed around the linear extent of the string by duplication of the light modules 21, duplication of the LED's 25, 27, 29, 31, and 33 or by light piping. Referring to FIG. 18, a series of light modules 21 connected by a series of conductor sets 75 are oriented to all project light to one side (the right side taken with respect to the viewer of FIG. 18. This configuration can be achieved by providing shaped light modules 21 to enable them to be visually registered with respect to a support structure as well as glued or adhesively placed against a structure. In cases where a permanent sign or display is being constructed, the permanent affixation of one light module 21 would not prevent a faulty light module 21 from being replaced and re-affixed to a surface. In some cases the connectors for the light modules 21 may be oriented to connect and disconnect based upon being lifted up and out of a supported position.

Figure 19:
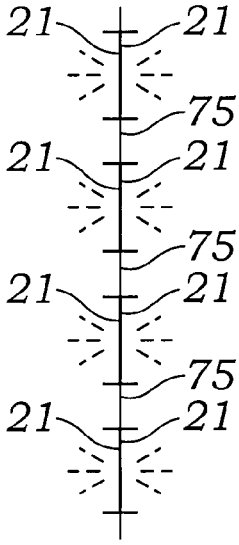
FIG. 19 illustrates a schematic view of a string of light modules which are evenly spaced, separated by conductors, and in which light modules are provided in back to back pairs such that illumination is directed to opposite sides of the string of light modules.

Referring to FIG. 19, a series of light modules 21 connected by a series of conductor sets 75 are duplicated to project light to both sides of the string. oriented to all project light to one side (the right side taken with respect to the viewer of FIG. 18. The controllers 23 in each of the light modules 21 may have the same address and some mechanism to insure that they are sensed as a single unit to prevent confusion as to number and location. In the alternative, two sets of LED's 25, 27, 29, 31, and 33 may be provided for a single controller 23. Note in FIG. 19 that the two light modules 21 are placed back-to-back and are oriented to radiate light oppositely.

Figure 20:
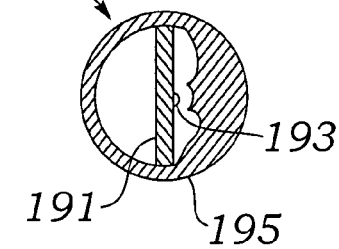
FIG. 20 is a lateral cross section of one configuration of a light module in which a support supporting a light emitting diode is surrounded by a specialized light transmissive housing for capturing and redistributing light from the light emitting diode.

Since the light modules 21 may have specialized housings, light piping may be easily facilitated. Referring to FIG. 20, a cross sectional view illustrates a light module 21 which can be seen as having a support 191 which may be an inner housing, a circuit board or other stable structure, and an LED 193 which may be one of the LED's 25, 27, 29, 31, and 33, or a plurality of LED's. A housing 195 is made of light transmissive material and includes a structure lying closely adjacent to the LED 193 to capture and redistribute as much of the light from the LED 193 as is possible. The re-direction is based not only upon the shape of the housing 195, but also upon the anisotropic structure of the housing 195. The manner of making and formation of the housing 195 can cause the light to be distributed over all of its surface, over half of its surface, such as the right half of the housing 195 seen in FIG. 20, or in a given pattern along the light path.

Figure 21:
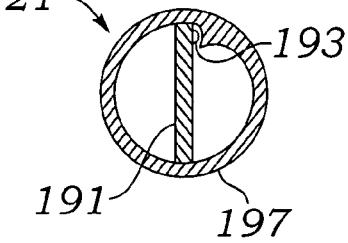
FIG. 21 is a lateral cross section of another configuration of a light module in which a support supporting a light emitting diode is surrounded by a specialized light transmissive housing for capturing and redistributing light from the light emitting diode in a circular direction generally orthogonal to an expected entent of a series of light modules.

The housing 195 can be formed to spread the light evenly over its surface, or selectively in a pattern using internal anisotropic structures within the housing 195 to make an external pattern. Further, where Snell's law is used, the light can be caused to emanate from the surface of the housing 195 based upon the shape and location of smooth areas and rough areas. Referring to FIG. 21, a cross sectional view similar to that of FIG. 20 illustrates that the LED 193 is located to radiated into a housing 197 in a manner which facilitates a circular propagation around the overall length of the light module 21. Light will escape to the outside of the housing in proportion to areas where its ability for total internal reflection is interrupted. The material used to construct the housings 195 and 197 (including its refractive index) can be controlled and selected as needed to match the light frequencies of the LED 193, as well as the LED's 25, 27, 29, 31, and 33. Further, the material and refractive index for housings 195 and 197 can provide further spatial control and color control. The housings 195 and 197 can be controlled and selected as needed to match the light frequencies of the LED 193, as well as the LED's 25, 27, 29, 31, and 33. Further, it is possible for the LED's 25, 27, 29, 31, and 33 to be white light or other homogeneous light frequency LED's with the color blending based upon colors and filters located within portions of the housings 195 and 197.

For example, the areas of the housings 195 and 197 over a series of white light LED's 25, 27, 29, 31, and 33 would create an effect similar to actuating different color LED's 25, 27, 29, 31, and 33 to create different composite frequencies of light. The ability to use housings 195 and 197 for a single light module 21 enable a "softening" of the "point source" of light from a light emitting diode. Most conventional light emitting diodes may have a naturally dispersive polymeric light transmissive housing in an attempt to spread the light over a wider area. The housings 195 and 197 can cause the light to be bathed circumferentially about the light module 21.

As an expansion on the ability to cause the light to be bathed circumferentially about the light module 21, the housings 195 and 197 can also provide for enabling the light to be distributed longitudinally, first to fill any gaps between adjacent light modules 21, as well as to visually obscure the boundaries between any two of the light modules 21.

Figure 22:
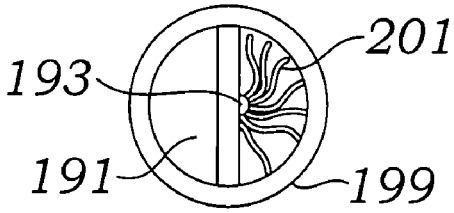
FIG. 22 is a lateral cross section of another configuration of a light module in which a support supporting a light emitting diode is surrounded by a non-specialized light transmissive housing and in which a light dispersive bundle is interposed.

Further, where the toughness and durability of the housings 195 and 197 require that they be constructed of a material which cannot be efficiently used as a light propagating material, the housings 195 and 197 can be made of plain light transmissive material, with any light distribution to occur with a specialized structure within the housings 195 and 197 and outside of the support 191. Referring to FIG. 22, a support 191 is surrounded by a simple light transmissive housing 199. A light distribution bundle 201 is inserted between the simple light transmissive housing 199 and the LED 193. The light distribution bundle 201 may be a semi fused bundle of fiber optic cables or other light distributive structure. Further, where a series of different colored LED's 25, 27, 29, 31, and 33 are used, a light distribution bundle 201 may assist in the spatial blending of the colors of the colored LED's 25, 27, 29, 31, and 33 to help prevent any spatial segregation which occurs upon differential energization of the colored LED's 25, 27, 29, 31, and 33 to produce a composite color output.

Figure 23:
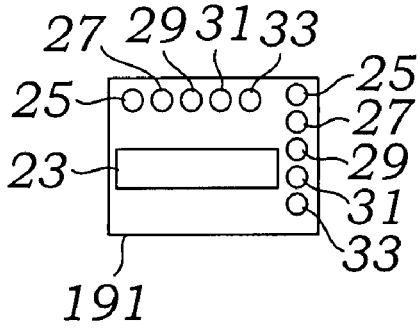
FIG. 23 is a plan view of one embodiment of a support which may be a circuit board and in which two different distributions for light emitting diodes are shown.

Referring to FIG. 23 a side view of a support 191 illustrates several possible configurations for the placement of the colored LED's 25, 27, 29, 31, and 33. The colored LED's 25, 27, 29, 31, and 33 can be distributed vertically or orthogonal to the string of light modules 21, or the colored LED's 25, 27, 29, 31, and 33 can be distributed linearly, generally parallel to the string of light modules 21, or a combination of both. Further, the colored LED's 25, 27, 29, 31, and 33 can be supplied multiply, both for the purpose of attaining better blending and composite color generation. FIG. 23 can also illustrate the reverse side of the support 191 where the support 191 has colored LED's 25, 27, 29, 31, and 33 on both sides.

Further where it is necessary or otherwise desirable to locate the colored LED's 25, 27, 29, 31, and 33 on a segregated portion of the support 191, the light can be spread across other portions of the support 191 by the use of structures which are an integral part of the housings 195 and 197, or by light distribution bundle 201. If the other components seen in FIG. 23 or in FIG. 21 can be made small enough, the colored LED's 25, 27, 29, 31, and 33 may come to dominate the physical space of the light module 21, and spatial distribution problems, or spatial distribution desired effects may be achieved by simple arrangement of the colored LED's 25, 27, 29, 31, and 33.

Figure 7:
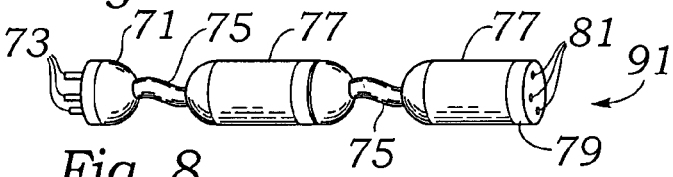
FIG. 7 is a perspective view of a two connector set.
Figure 8:
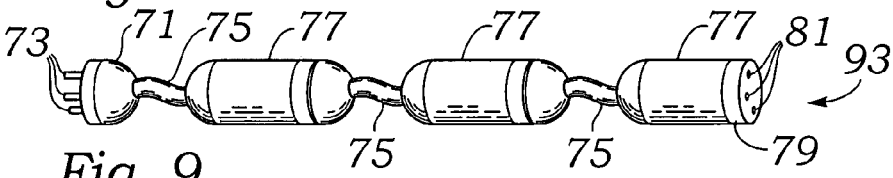
FIG. 8 is a perspective view of a three connector set.
Figure 24:
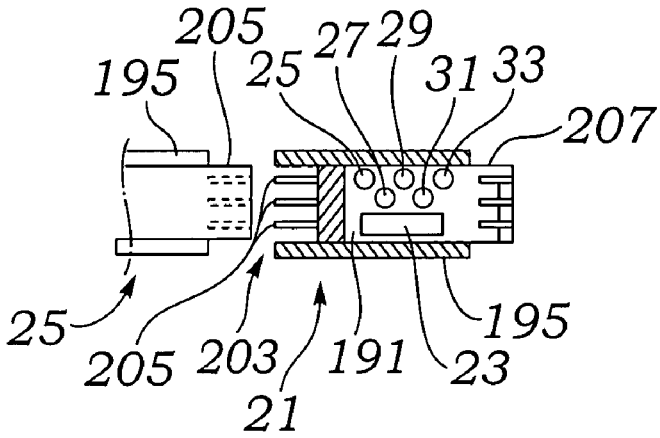
FIG. 24 is a side sectional view of a plug system in which a support is positioned within a housing made of light transmissive material is positioned to enclose a male plug portion in order that exterior light transmission between adjacent light modules 21 has minimum interruption.

Conversely, where long sections of the light module 21 are to physically achieve the same color, an elongated spreading structure may be located in the housings 195 and 197, or an elongated light distribution bundle 201 can be utilized. In addition, operating or adjusting the output of individual ones of the colored LED's 25, 27, 29, 31, and 33 by pulse actuation is also a possibility. Spreading the pulse modulated light output among the series of colored LED's 25, 27, 29, 31, and 33 will help visually obscure the "center of illumination" as well as to provide a scintillation effect.

Where a physical connection between light modules 21 is to be achieved, and to prevent an interruption of a continuous light effect, the housings 195 and 197 can have portions which extend toward an adjacent light module. Whereas the simplified view of FIG. 7 illustrated the interconnectivity aspect, a view of FIG. 24 illustrates a continuity and coverage aspect. A light module 21 has a housing 195 which surrounds a support 191 which supports the series of colored LED's 25, 27, 29, 31, and 33. The housing 195 acts to optically transmit light from the series of colored LED's 25, 27, 29, 31, and 33, throughout the complete external surface of the housing 193. An inset male plug section 203 with inset prongs 205 is surrounded by a portion of the housing 195 so that the area immediately within the male plug section externally appears to output light. A female plug section 207 is seen as not being surrounded by a portion of the housing 195, but the housing 195 is seen to extend up to the base of the female plug section 207. In the configuration shown, the length of the light module 21 which is used for providing interconnection is covered by a portion of the light transmissive housing 195. Depending upon how the light transmissive housing 195 is configured, it may provide continuous even light output along the whole of its exterior surface, from a point even with the male plug section 203 until the start of the female plug section 207.

Figure 25:
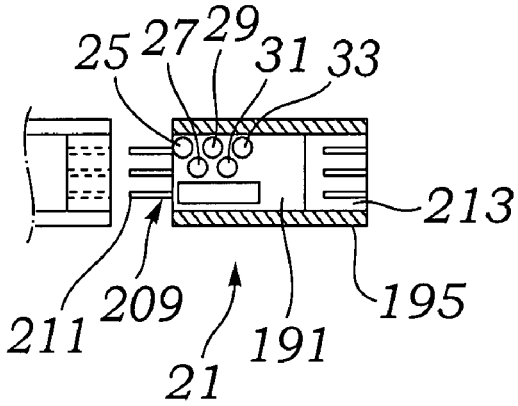
FIG. 25 is a side sectional view of a plug system in which a support is positioned within a housing made of light transmissive material is positioned to enclose a female plug portion in order that exterior light transmission between adjacent light modules 21 has minimum interruption.

Alternatively, the light transmissive housing 195 can be extended to cover a female plug section. Referring to FIG. 25, a male plug section 209 has externally extending prong members 211 which protrude beyond the extent of the light module 21. A light transmissive housing 195 only extends to the start of the male plug section 209. At the other end of the light module 21, the light transmissive housing 195 extends to surround a female plug section 213. Likewise, depending upon how the light transmissive housing 195 is configured, it may provide continuous even light output along the whole of its exterior surface, from a point even with the base of the male plug section 209 until the end of the female plug section 207. In either of the configurations of FIG. 24 or 25, the physical exterior surface light transmission for each of the light modules 21 will extend evenly and immediately adjacent to the surface light transmission for each of the adjacent light modules 21 to which it is connected. Other patterns than simple abutment for the abutting edges of the light transmissive housing 195 are possible, including interlocking fingers and articulated joints which can provide limited angular interfitting of one light module 21 with another.

While the present invention has been described in terms of a lighting system which is "sculptable" and which can used different lengths of modules and have varying levels of distributed control from rudimentary to completely integrated, the present system and its inventive aspects may be applied in any situation where intelligent communication and control architecture may be employed to increase the utility of installation and operation by enabling a flexible building block method of system building.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A lamp module comprising:

a housing support;

a voltage/current supply line, having an first end and a second end, and supported by said housing support;

a ground line having a first end and a second end and supported by said housing support;

a first control line supported by said housing support, having a first end and a second end;

a second control line supported by said housing support, having a first end and a second end;

a controller having a first connection to said second end of said first control line, at least one current switching input, and a second connection to said first end of said second control line output, and a power input connected to said voltage/current supply line, a ground connection connected to said ground line, said controller configured to control access of said current switching input to said ground line;

at least one light emitting diode having a current input connected to said voltage/current supply line and a current output connected to a corresponding current switching input of said controller.

2. The lamp module of claim 1 wherein said and further comprising a shunt line connecting said second end of said control line input and said first end of said control line output.

3. The lamp module of claim 1 and further comprising a capacitor between said voltage/current supply line and said ground line for helping to maintain a voltage of said voltage/current supply line during intermittent periods of current flow through said at least one light emitting diode and any other current user of said voltage/current supply line internal or external with respect to said lamp module.

4. The lamp module of claim 1 wherein said at least one light emitting diode is at least two light emitting diodes of different colors and wherein said controller is configured to control access of said current switching input to modulate the intensity of said at least two light emitting diodes to emit a controlled composite color.

5. The lamp module of claim 1 wherein said other lamp modules connected in series to each other includes branch connections to each other.

6. The lamp module of claim 1 wherein said controller having first connection to said second end of said control line and a second connection to said first end of said control line is configured to receive and re-transmit an counter signal indicative of the number of other lamp modules connected in series to each other and to said lamp module on at least one of said first and second connections.

7. The lamp module of claim 1 wherein said controller having first connection to said second end of said control line and a second connection to said first end of said control line is configured to assume control of the number of other lamp modules connected in series to each other and to said lamp module on at least one of said first and second connections in the absence of an external master controller, and control said other lamp modules connected to said lamp module on at least one of said first and second connections.

8. The lamp module of claim 7 wherein said assume control of a number of other lamp modules connected in series to each other and to said lamp module on at least one of directing said LED's of said lamp module and other lamp modules to operate and shut down at scheduled times, control of selection and execution of different lighting patterns during different portions of the day for said LED's of said lamp module and other lamp modules, control of a sequence pattern of for said LED—s of said lamp module and other lamp modules so that they flash the patterns, and control a real time system status check system to report on the state of said LED—s of said lamp module and other lamp modules.

9. The lamp module of claim 7 wherein said assume control of a number of other lamp modules connected in series to each other and to said lamp module on at least one of said first and second connections in the absence of an external master controller includes at least a first LED pattern which is communicated to said other lamp modules connected to said lamp module on at least one of said first and second connections.

10. The lamp module of claim 7 wherein said assume control of a number of other lamp modules connected in series to each other and to said lamp module on at least one of said first and second connections in the absence of an external master controller includes at least a synchronization signal which is communicated to said other lamp modules connected to said lamp module on at least one of said first and second connections.

11. The lamp module of claim 1 and further comprising a multiplicity of said lamp modules connected in series to each other and further comprising a master controller connected to one of multiplicity of said lamp modules which is connected to only one other of said multiplicity of lamp modules and wherein said master controller controls said multiplicity of said lamp modules.

12. The lamp module of claim 11 and further comprising a multiplicity of said lamp modules connected in series to each other and further comprising a power supply connected to any one of said multiplicity of said lamp modules.

13. The lamp module of claim 11 wherein said multiplicity of said lamp modules each has an address and wherein master controller is configured to receive said addresses and derive an pattern map of said multiplicity of said lamp modules.

14. The lamp module of claim 11 wherein said multiplicity of said lamp modules, master controller form a modular light system and further comprising:

a plurality of said modular light systems; and, a master system housing supporting said plurality of modular light systems; and a power supply supported by said master system housing and connected to at least one of said plurality of said modular light systems.

15. The lamp module of claim 11 wherein at least two of said multiplicity of said lamp modules are connected with an interconnector cord

16. The lamp module of claim 1 wherein said housing support includes at least one of a male plug and a female plug.

17. The lamp module of claim 1 wherein said housing support includes at least one extended conductor set.

18. The lamp module of claim 1 wherein said housing support includes a light transmissive anisotropic material.

* * * * *